US010611554B2

(12) United States Patent
Schroer et al.

(10) Patent No.: US 10,611,554 B2
(45) Date of Patent: Apr. 7, 2020

(54) DISPENSER FOR VALVE WITH STATIONARY VALVE STEM HOUSING

(71) Applicant: DDP SPECIALTY ELECTRONIC MATERIALS US, INC., Collegeville, PA (US)

(72) Inventors: Daniel R. Schroer, Midland, MI (US); Marc S. Black, Midland, MI (US); Chad V. Schuette, Midland, MI (US); Christopher J. Siler, Midland, MI (US); Daniel Ramirez, Midland, MI (US)

(73) Assignee: DDP SPECIALTY ELECTRONIC MATERIALS US, INC, Collegeville, PA (US)

( * ) Notice: Subject to any disclaimer, the term of this patent is extended or adjusted under 35 U.S.C. 154(b) by 0 days.

(21) Appl. No.: 16/380,060

(22) Filed: Apr. 10, 2019

(65) Prior Publication Data

US 2019/0308797 A1 Oct. 10, 2019

Related U.S. Application Data

(60) Provisional application No. 62/655,292, filed on Apr. 10, 2018.

(51) Int. Cl.
*B65D 83/30* (2006.01)
*B65D 83/20* (2006.01)
(Continued)

(52) U.S. Cl.
CPC ..... *B65D 83/306* (2013.01); *B65D 83/201* (2013.01); *B05B 11/3053* (2013.01); *B65D 83/303* (2013.01); *B65D 83/48* (2013.01)

(58) Field of Classification Search
CPC .... B65D 83/306; B65D 83/303; B65D 83/48; B05B 11/3053
See application file for complete search history.

(56) References Cited

U.S. PATENT DOCUMENTS 3,506,241 A 4/1970 Ewald
4,436,229 A 3/1984 Beard
(Continued)

FOREIGN PATENT DOCUMENTS

JP 3096635 U 9/2003
WO 2017074756 A1 5/2017
(Continued)

OTHER PUBLICATIONS

C. Ehrensperger AG, Ehrensperger Pageris dispenser, http://www.ehrensperger-ag.ch/en/products/aerosol-technology/dispenser/.
(Continued)

*Primary Examiner* — Jeremy Carroll
(74) *Attorney, Agent, or Firm* — Andrew G. Bunn

(57) ABSTRACT

An article includes a dispenser having a flow channel extending therethrough and having a base, a bendable segment attached to the base, a straw attached to the bendable segment, a plunger attached to the base and extending within the flow channel of the bendable segment; a sleeve extending over at least a portion of the straw, and a trigger hingedly attached to the straw at a hinge point and having a portion above the hinge point engaging the sleeve and a trigger portion extending below the hinge point.

8 Claims, 3 Drawing Sheets

(51) Int. Cl.
*B65D 83/48* (2006.01)
*B05B 11/00* (2006.01)

(56) References Cited

U.S. PATENT DOCUMENTS

| | | | | |
|---|---|---|---|---|
| 4,856,684 | A | 8/1989 | Gerstung | |
| 5,549,226 | A * | 8/1996 | Kopp | B65D 83/303 222/402.13 |
| 5,702,036 | A | 12/1997 | Ferrara, Jr. | |
| 5,850,952 | A * | 12/1998 | Morck | B65D 83/303 222/530 |
| 2007/0090133 | A1* | 4/2007 | MacLeod | B65D 83/753 222/402.13 |
| 2012/0097180 | A1* | 4/2012 | Harris | B65D 83/206 132/200 |
| 2013/0320045 | A1 | 12/2013 | Hoagland et al. | |
| 2014/0224828 | A1* | 8/2014 | Demey | B05B 1/3073 222/23 |
| 2016/0223097 | A1* | 8/2016 | Demey | B65D 83/303 |

FOREIGN PATENT DOCUMENTS

| | | | |
|---|---|---|---|
| WO | 2017139128 | A1 | 8/2017 |
| WO | 2017139131 | A1 | 8/2017 |

OTHER PUBLICATIONS

International Search Report dated Jul. 12, 2019, for corresponding International Application No. PCT/US2019/026729, filed on Apr. 10, 2019.

* cited by examiner

DISPENSER FOR VALVE WITH STATIONARY VALVE STEM HOUSING

BACKGROUND OF THE INVENTION

Field of the Invention

The present invention is a dispenser for a valve having a valve cup, and depressible valve stem in a stationary valve stem housing.

INTRODUCTION

Dispensing fluid, particularly foamable fluid, from a compressed can is useful for many products including whipped dairy toppings and spray foam for sealing and thermal insulation applications. Foamable fluid is often available as foamable liquid under pressure in a can that is dispensed through an application tube attached to a valve or valve stem on the can. Upon release from the pressurized can the foamable liquid expands into foam.

Many types of compressed cans of fluid comprise a valve that can be opened by tilting the valve stem of the valve assembly. Examples of such valves are taught in U.S. Pat. Nos. 3,506,241, 4,436,229, and 4,856,684. Dispensers for opening such valves by attaching to the actual valve stem and tilting the valve stem are the subject of numerous dispenser technologies including those disclosed in US2013/0320045, WO2017/139128 and WO2017/139131.

Dispensers designed to tilt a valve stem to dispense fluid are not suitable for use on cans that comprise a valve without a tilting valve stem assembly. For example, C. Ehrensperger AG offer PAGERIS™ valves for cans that have a valve cup around a stationary valve stem housing in which a depressible valve stem resides and that extends out from or is accessible through only the top of the valve stem housing. Such a valve assembly shall generically be called herein a "Pageris-type" valve. The stationary valve stem housing prevents tilting of the valve stem to open the Pageris-type valve and requires depressing the valve stem through the top of the stationary valve stem housing to open the Pageris-type valve. Pageris-type valves have a place in the industry that necessitates providing a dispenser for them that can readily be actuated by a single hand that is holding the can. Additionally, it is desirable if the dispenser seals the dispensing device when closed so as to preclude expansion and/or dripping of fluid when a user is not intending to dispense fluid. Moreover, it is desirable if the dispenser can simultaneously open the Pageris-type valve of a can and unseal with a single actuating motion and simultaneously close the Pageris-type valve of a can and seal the dispenser to preclude dripping with a single actuating motion.

BRIEF SUMMARY OF THE INVENTION

The present invention provides a dispenser that can open a can of compressed fluid having a Pageris-type valve by actuating with a single hand. Moreover, the dispenser of the present invention can seal to prevent dripping when not actuated to dispense fluid. Even more, in some embodiments, the dispenser can simultaneously open the Pageris-type valve of a can and unseal a dispenser with a single actuating motion and simultaneously close the Pageris-type valve of a can and seal the dispenser to preclude dripping with a single actuating motion.

The present invention is a result of discovering how to attach to a Pageris-type valve while enabling simultaneous and reversible sliding of a sleeve over the dispenser to unseal it while pressing a plunger against the valve stem of the can to open it. The dispenser attaches to the stationary valve stem housing and utilizes a plunger to depress the valve stem to open the valve.

In a first aspect, the present invention is an article (10) comprising a dispenser (20), wherein the dispenser comprises; (a) a base (36) that has a base side wall (30) separating opposing top (34) and bottom (33) ends with an entrance opening (35) to a flow channel (38) defined through the bottom end with the flow channel extending through the base within the base side wall and through an exit end; (b) a bendable segment (40) having a bendable segment side wall (42) separating opposing bottom (48) and top (43) ends and a flow channel (44) defined through the bottom of the bendable segment that extends through the bendable segment between the side wall and out the top end, where the bottom of the bendable segment is attached to the base so that there is fluid communication between the flow channel of the base and the flow channel of the bendable segment, the side wall comprising a compressible feature (49) that allows the bendable segment to tilt from a neutral position to a tilted position relative to the base; (c) a straw (50) having opposing entrance (53) and exit (54) ends separated by a straw wall (52) where the straw wall defines a flow channel (58) that extends within the straw wall through the entrance end and through an exit opening (56) proximate to the exit end of the straw; (d) a plunger (60) attached to the straw proximate to the straw entrance end or to the bendable segment proximate to its exit end, where the plunger extends within the flow channel of the bendable segment towards and optionally into the flow channel of the base and where the plunger is of dimensions and/or design so as to allow fluid communication around and/or through it within the flow channel of the bendable segment; (e) a sleeve (70) extending over at least a portion of the straw and that is able to slide over the straw along at least a portion of the straw wall, the sleeve having an exit opening (72) extending through it proximate to the exit end of the straw; and (f) a trigger (80) hingedly attached to the straw at a hinge point (82) and having a portion (84) of the trigger that engages the sleeve above the hinge point and a trigger arm (86) extending below the hinge point so that the trigger can move the sleeve without moving the straw by moving the trigger arm.

The present invention is useful for dispensing fluid from a can of compressed fluid that has a Pageris-type valve.

DETAILED DESCRIPTION OF THE INVENTION

"And/or" means "and, or alternatively". All ranges include endpoints unless otherwise stated. "Multiple" means more than one. "Fluid" refers to a substance that has no fixed shape and yields to external pressure and includes gas, liquid, and gas or liquid continuous formulations. Typically, though not necessarily, fluid refers to liquid and liquid continuous formulations as used herein.

Unless otherwise indicated in the context of its usage herein, orientation references are in reference to the direction of fluid flow from the can of the article through the dispenser flow channel as described in this paragraph. Terms referring to an elevated position of an element such as "top" or "above" refer to the portion of the element furthest along the direction of fluid flow. Terms referring to an elevating direction such as "up" refers to the direction of fluid flow as it is dispensed through the dispenser. Terms referring to a subordinate position of an element such as "bottom" or "below" refer to the portion of the element least far along the direction of fluid flow. Terms referring to a subordinate direction such as "down" refer to the opposite direction of fluid flow as it is dispensed through the dispenser.

The following description makes reference to FIGS. 1-3, 4A and 4B to facilitate understanding. However, for avoidance of any doubt, the FIGS. 1-3, 4A and 4B do not illustrate the full breadth of the invention but only embodiments of the elements of the invention to illustrate how they can fit together or be manifest. For avoidance of doubt, the broadest scope of the invention is intended to allow for embodiments of components as taught herein to be combined in any way physically allowable within the scope of the teaching and not be specifically limited to that illustrated in FIGS. 1-3, 4A and 4B. However, FIGS. 1-3, 4A and 4B do illustrate embodiments of the invention.

The following description generally identifies the element number from the Figures with the first mention of the element for the sake of easier reading.

Figure 1:
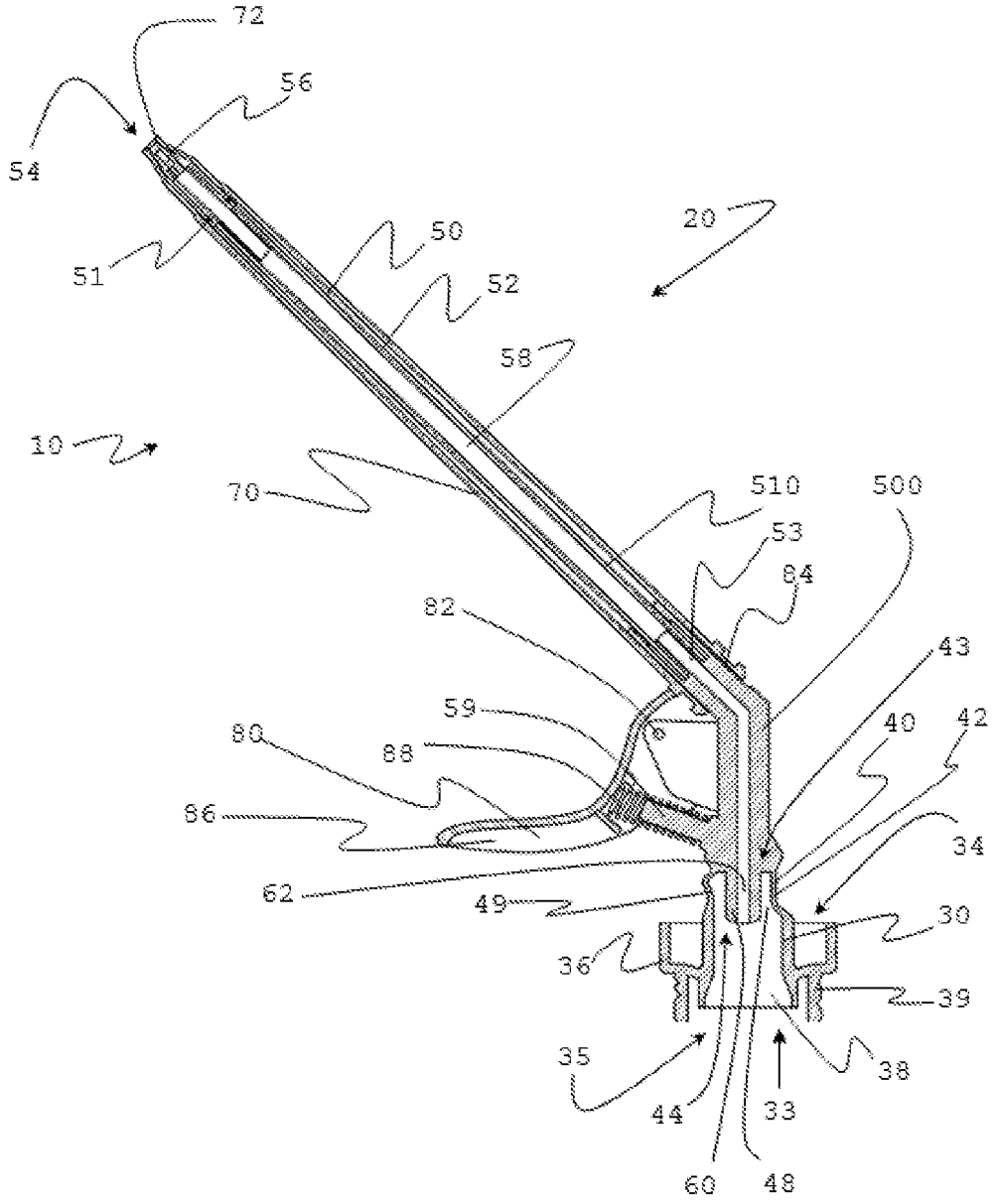
FIG. 1 illustrates a side cut-away view of a dispenser of the present invention.
Figure 2:
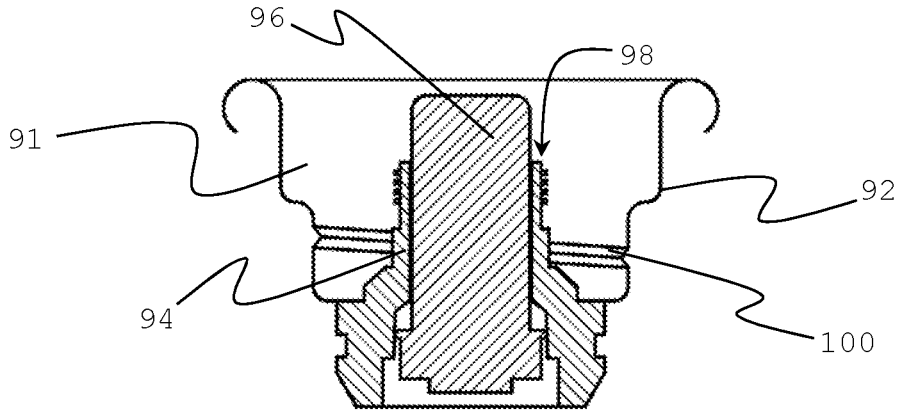
FIG. 2 illustrates a side cut-away view of a Pageris-type valve.
Figure 3:
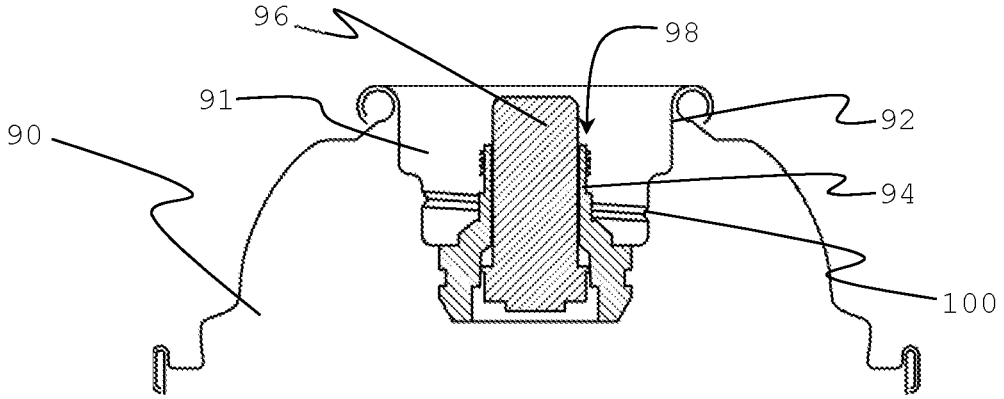
FIG. 3 illustrates a side cut-away view of a Pageris-type valve attached to a can.

The article (10) comprises a dispenser (20). FIG. 1 illustrates an example of a dispenser of the present invention. The dispenser comprises a base (36), a bendable segment (40), a straw (50), a plunger (60), a sleeve (70) and a trigger (80).

The base has opposing bottom (33) and top ends (34) with a base side wall (30) extending between the bottom end and top end. The bottom has an entrance opening (35) defined therethrough. A flow channel (38) extends through the entrance opening through the base within the base side wall and through to the top of the base. The base side wall defines the flow channel through the base with the "inside" of the base side wall exposed within the flow channel and the "outside" of the base side wall external to the flow channel. Threads (39) can be defined on the outside of the base side wall (FIG. 1). The threads are useful for screwing the base into the cup of a Pageris-type valve (for example, FIG. 4A and FIG. 4B) that has mating threads as described below.

The bendable segment (40) has opposing bottom (48) and top (43) ends with a bendable segment side wall (42) extending between the top end and bottom end. A flow channel (44) extends all the way through the bendable segment, through the bottom end and the top end. The bendable segment is attached such that the bottom end of the bendable segment attaches to the base proximate to the top end of the base such that there is fluid communication between the flow channel of the base and the flow channel of the bendable segment. The bendable segment and base can attach such that the top of the base and bottom of the bendable segment coincide. It is also conceivable that the bendable segment slips over a portion of the base (or vice versa) such that the top of the base is between the top and bottom of the bendable segment.

The bendable segment side wall comprises a compressible feature (49). The compressible feature enables the bendable segment to reversibly tilt with respect to the base. Examples of suitable compressible features include one or more than one indentation in the bendable segment side wall, one or more fold in the bendable segment side wall, or a corrugated section of the bendable segment side wall.

The bendable segment has a neutral position in which the compressible feature is uncompressed. Desirably, the flow channel of the base and flow channel of the bendable segment are in a straight line when the bendable segment is in its neutral position. When attached to a valve of a can, the can is closed when the bendable segment is in its neutral position.

The straw (50) has opposing entrance (53) and exit (54) ends separated by a straw wall (52). A straw flow channel (58) within the straw wall (hence, is defined by the straw wall) through the entrance end and through an exit opening (56) proximate to the exit end. The exit opening can be through the exit end of the straw or can be through the straw wall proximate to the exit end. The straw can have one exit opening or multiple exit openings.

The straw is attached to the bendable segment with the straw entrance end proximate to the bendable segment top end. The top of the bendable segment and the entrance end of the straw can coincide. Alternatively, the straw wall can slip over the bendable segment wall (or vice versa) so that the top end of bendable segments is between the entrance and exit ends of the straw.

The straw and bendable segment are attached such that the flow channel of the bendable segment is in fluid communication with the flow channel of the straw. The flow channels of the base, bendable segment and straw are all in fluid communication and form a dispenser flow channel through the dispenser that extends from the entrance opening of the base through the base, through the bendable segment and through the straw and out through the exit opening of the straw.

Figure 4A:
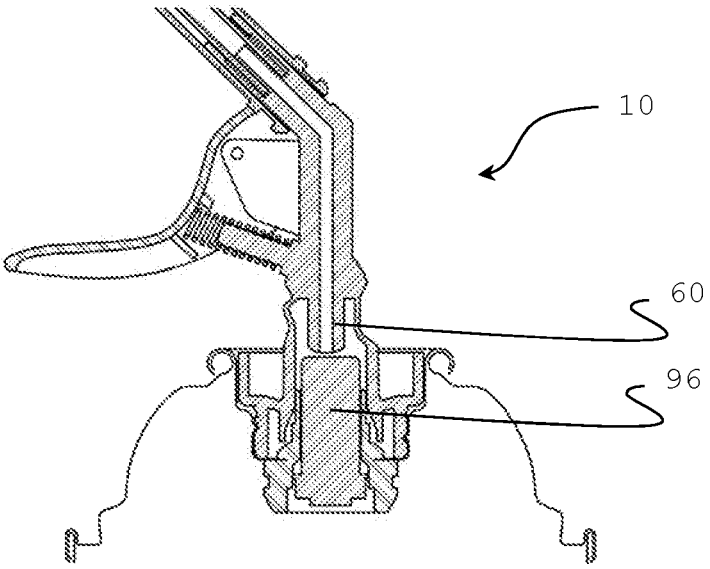
FIG. 4A illustrates the dispenser of FIG. 1 attached to the Pageris-type valve and can of FIG. 3 and illustrates them in a closed orientation.
Figure 4B:
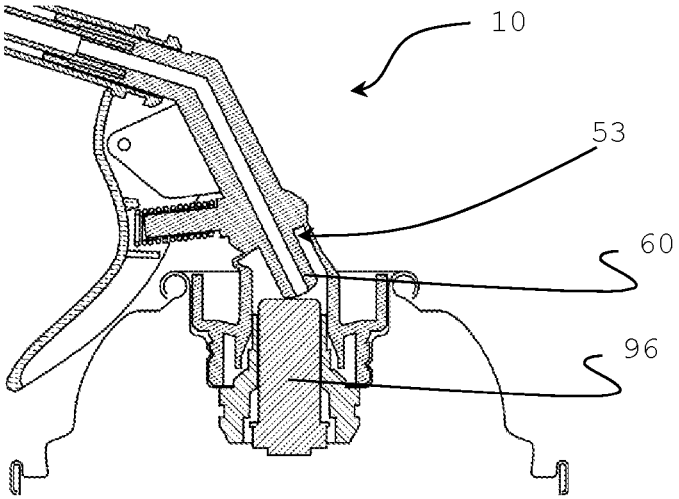
FIG. 4B illustrates the dispenser of FIG. 1 attached to the Pageris-type valve and can of FIG. 3 and illustrates them in a tilted or open configuration.

When the bendable segment is in its neutral position, the dispenser flow channel can extend in a straight line all the way through the base, bendable segment and straw. Alternatively, the dispenser flow channel can extend in a straight line through the base and bendable segment and then bend at an angle within the straw. For example, the straw can have an elbow section (500) and a straight section (510) as shown in FIGS. 1, 4A and 4B. The benefit of including an elbow section is to allow the dispenser to direct fluid flow at a more convenient angle than straight in line out from the top of a can.

A plunger (60) is attached to the straw proximate to the straw entrance end or the bendable segment proximate to its entrance end and extends within the flow channel of bendable segment towards and optionally into the base flow channel. While the plunger extends within the flow channel, it does not block fluid communication through the flow channel. In that regard, the plunger is of sufficient dimensions and/or design so as to allow fluid communication around and/or through it within the flow channel of the bendable segment and through the dispenser flow channel. For example, the plunger can have a narrower diameter than the diameter of the flow channel in which it resides. Additionally, or alternatively, the plunger can have a design that includes one or more than one hole defined through it that allows fluid flow through the plunger.

The plunger can essentially be an extension of the straw into the flow channel of the bendable segment with the bendable segment side wall attached to the straw wall above the entrance of the straw and between the entrance and exit ends. The dispenser in FIGS. 1, 4A and 4B illustrates a plunger that can be viewed as an extension of the straw into the flow channel of the bendable segment. In such a manifestation, the plunger has a hole (62), or flow channel, defined through it that provides fluid communication through the plunger and between the flow channel of the bendable segment and the straw.

The sleeve (70) extends over at least a portion of the straw. The sleeve can extend over the exit end of the straw. Alternatively, the sleeve can be free of a portion that extends over the exit end of the straw. The sleeve has an exit opening (72) extending through the sleeve proximate to the exit end of the straw. When fluid is dispensed through the dispenser it travels through the flow channel of the dispenser and out from the exit opening of the straw and through the exit opening in the sleeve. Desirably, there is a gasket (51) extending circumferentially around the straw between the entrance opening and exit opening of the straw (preferably, proximate to the exit opening) and between the sleeve and the straw that contacts both the sleeve and straw wall so as to form a seal between the two around the straw. Such a gasket serves to preclude fluid from flowing between the straw and sleeve. Suitable gaskets include an O-ring. The gasket can reside in a groove in the straw wall, the sleeve, both the sleeve and straw wall, or just reside freely without residing in any groove.

The sleeve is able to slide over the straw along the straw wall. Desirably, the sleeve slides along the straw between a "closed position" and an "open position". When the sleeve is in a "closed position" it seals all exit openings of the straw, preventing fluid flow from the dispenser flow channel through exit opening(s) in the straw. When the sleeve is in an "open position" the sleeve is free from at least one exit opening of the straw meaning fluid is free to flow from the flow channel through the straw and through the exit opening of the straw. Desirably, sliding the sleeve towards the exit end of the straw when the sleeve is in a closed position moves the sleeve into an open position. Similarly, sliding the sleeve towards the entrance end of the straw when the sleeve is in an open position will move the sleeve into a closed position.

When the sleeve is in a closed position the sleeve seals the exit opening of the straw. This precludes dripping of fluid from the dispenser when closed. In the broadest scope of the invention, the means of sealing the exit end of the straw is without limit. For example, the sleeve can press against the straw wall around and extend over the exit opening thereby blocking fluid communication from the straw flow channel through the exit opening of the straw. Examples of such a means of the sleeve sealing the exit opening of the straw are taught in WO2017/139128. For example, the straw can have a tapered exit end with one or multiple exit openings and the sleeve can have a tapered exit end that conforms to the taper on the straw and presses against the straw when in the closed position so as to seal the exit opening(s) of the straw. The sleeve can additionally or alternatively comprise a protrusion that extends at least partially into the exit opening of the straw to seal the exit opening when in the closed position. Examples of such means by which the sleeve seals the exit opening of the straw when in the closed position are taught in WO2017/139131. For example, the exit opening of the straw can be through the exit end of the straw and the sleeve can define a protrusion that extends into the exit opening of the straw when in the closed position. The sleeve desirably has one or more than one exit opening around the protrusion to allow fluid flow out from between the straw and sleeve when in the open position. As another example, the straw can have one or more than one exit opening through the straw wall proximate to but not on the exit end of the straw and the sleeve can have a protrusion for each exit opening of the straw that fits into each exit opening to seal them when the sleeve is in the closed position. In such an embodiment, the sleeve can either extend over the exit end of the straw and have exit opening(s) through its wall or be free of any portion of sleeve that extends over the exit end of the straw and essentially have an exit opening over the exit end of the straw.

The trigger (80) hingedly attaches to the straw of the dispenser at a hinge point (82) in such a way that the trigger can move without moving the straw. For example, the straw can have a protrusion around which a portion of the trigger extends and a pin can extend through the protrusion and portion of the trigger to establish a hinged attachment. Alternatively, the trigger can attach to the straw by means of a flexible material or an article comprising a flexible or compressible element that allows for hinged bending of the trigger with respect to the straw.

The trigger has a sleeve engagement portion (84) that engages the sleeve above the hinge point. That is, the location where the sleeve engagement portion engages the sleeve is closer to the exit opening of the sleeve than where the trigger hingedly attaches to the straw. The sleeve engagement portion can engage the sleeve in any manner that allows movement of the sleeve engagement portion relative to the straw to cause the sleeve to move along the straw wall. For example, the sleeve engagement portion can engage the sleeve by extending protrusions on either side of the sleeve within a groove defined on the sleeve. Alternatively, the sleeve engagement portion can define an eyelet that extends circumferentially around the sleeve and that resides at least partially within a groove of the sleeve and/or between protrusions in the sleeve. Or, the sleeve engagement portion can flexibly attach to the sleeve. In the broadest scope of the invention, the means by which the sleeve engagement portion engages the sleeve is unlimited provided that it allows displacement of the sleeve engagement portion relative to the straw to induce the sleeve to slide along the straw wall.

The trigger has a trigger arm (86) that extends below the hinge point and generally radially out from the straw. That is, the trigger arm extends from the hinge point in a direction generally opposite from the sleeve engagement portion so that moving the trigger arm in the general direction of the dispenser base causes the trigger to hinge at the hinge point and displace the sleeve engagement portion towards the exit end of the straw. The trigger arm is generally long enough to allow a user's finger to be placed on it and to apply pressure to the trigger arm in order to actuate the sleeve to an open position from a closed position. The trigger and trigger arm are in a "closed" position when located so as to allow the sleeve to be in a closed position. The trigger and trigger arm are in an "open" position when they are located in a position that causes the sleeve to be in an open position. Depressing the trigger arm generally towards the base while in the closed position typically displaces the trigger arm and sleeve into their open positions.

Desirably, there is an elastic element (88) located between the trigger arm and base and/or straw that establishes a force on the trigger arm directing the trigger arm to a closed position while in the open position. For example, the elastic element can be a spring that is compressed when a force is applied to the trigger that moves it from its closed position to its open position and a restorative force of the spring applies a force to restore the trigger to its closed position when the applied force is removed.

Desirably, the straw further comprises a protrusion (59) extending towards the trigger arm, generally radially out from the straw. The protrusion acts as a stop against which the trigger arm presses when moved to an open position. Applying further force to the trigger arm in the direction of the open position when the trigger arm contacts the protrusion (59) causes the dispenser to bend at the compressible feature of the bendable segment. The dispenser can have a protrusion (59) with a spring serving as an elastic element (88) residing over the protrusion, as illustrated in FIGS. 1, 4A and 4B.

The article of the present invention can further comprise a can (90) having a Pageris-type valve (91). A Pageris-type valve has a valve cup (92) around a stationary valve stem housing (94) in which a depressible valve stem (96) resides. The depressible valve stem extends out from the top (98) of the stationary valve stem housing or is accessible within the valve stem housing through the top of the valve stem housing. The stationary valve stem housing is typically a cylindrical structure. The stationary valve stem housing is rigidly attached to the valve cup so that it cannot tip, bend or compress relative to the valve cup. The stationary valve stem housing serves the purpose of protecting the valve stem from accidentally being depressed. Depressing the valve stem (that is, displacing the valve stem towards the can within the valve stem housing) opens the valve and provides fluid communication from inside the can to outside the can, releasing pressurized fluid that is within the can. When the valve stem is depressed so as to open the valve then the valve and valve stem are in an "open position", otherwise they are in a "closed position". When the valve stem is in the closed position the can is sealed shut. Typically, the pressure from the can, or an elastic element (such as a spring) between the valve cup and valve stem keeps the valve stem in a closed position until actively depressed to the open position.

The dispenser attaches to the valve of the can by inserting the base into the valve cup while inserting the stationary valve stem housing into the entrance opening of the base. Desirably, the valve cup has threading (100) defined in it that mates with threading (39) on the outside wall of the base facilitating screwing the base into the valve cup to attach the dispenser to the valve.

When attached to a Pageris-type valve of a can, the dispenser acts as a single-action dispenser that, with a single action, can both move the dispenser from a closed position to an open position and open the valve of the can. Likewise, a single action can close the can and move the dispenser from an open position to a closed position. The plunger of the dispenser desirably extends far enough into the flow channel of the dispenser so that when the dispenser is attached to the valve of a can, the valve remains closed when the dispenser is closed, yet far enough that the plunger depresses the valve stem sufficiently to open the valve when the bendable segment is tilted from its neutral position to a tilted position. Hence, by applying downward force (towards the can) to the trigger arm when the closed dispenser is attached to a closed Pageris-type valve of a can the sleeve slides to an open position and the bendable segment moves from a neutral position to a tilted position thereby opening the valve of the can. Likewise, moving the trigger arm up (away from the can) when the can and dispenser are in an open configuration allows the Pageris-valve to close and the dispenser to move into a closed orientation. In this manner, the dispenser precludes dripping of fluid out from the straw when it is in the closed position but only requires a single action to dispense fluid from a can having a Pageris-type valve.

What is claimed is:

1. An article (10) comprising a dispenser (20), wherein the dispenser comprises:

(a) a base (36) that has a base side wall (30) separating opposing top (34) and bottom (33) ends with an entrance opening (35) to a flow channel (38) defined through the bottom end with the flow channel extending through the base within the base side wall and through an exit end;

(b) a bendable segment (40) having a bendable segment side wall (42) separating opposing bottom (48) and top (43) ends and a flow channel (44) defined through the bottom of the bendable segment that extends through the bendable segment between the side wall and out the top end, where the bottom of the bendable segment is attached to the base so that there is fluid communication between the flow channel of the base and the flow channel of the bendable segment, the side wall comprising a compressible feature (49) that allows the bendable segment to tilt from a neutral position to a tilted position relative to the base;

(c) a straw (50) having opposing entrance (53) and exit (54) ends separated by a straw wall (52) where the straw wall defines a flow channel (58) that extends within the straw wall through the entrance end and through an exit opening (56) proximate to the exit end of the straw;

(d) a plunger (60) attached to the straw proximate to the straw entrance end or to the bendable segment proximate to its exit end, where the plunger extends within the flow channel of the bendable segment towards and optionally into the flow channel of the base and where the plunger is of dimensions and/or design so as to allow fluid communication around and/or through it within the flow channel of the bendable segment;

(e) a sleeve (70) extending over at least a portion of the straw and that is able to slide over the straw along at least a portion of the straw wall, the sleeve having an exit opening (72) extending through it proximate to the exit end of the straw; and (f) a trigger (80) hingedly attached to the straw at a hinge point (82) and having a portion (84) of the trigger that engages the sleeve above the hinge point and a trigger arm (86) extending below the hinge point so that the trigger can move the sleeve without moving the straw by moving the trigger arm.

2. The article of claim 1, wherein the sleeve has a closed position relative to the straw in which the sleeve seals the exit opening of the straw and when the sleeve moves from the closed position away from the entrance end of the straw it unseals the exit opening of the straw causing the sleeve to be in an open position in which there is fluid communication from the straw flow channel through the straw exit opening and through the sleeve exit opening.

3. The article of claim 1, wherein the straw has a protrusion (59) between where the hinge point and where the bendable segment reside, such that the protrusion extends from the straw towards the trigger arm of the trigger.

4. The article of claim 1, wherein the compressible feature defined in the wall of the bendable segment is a corrugated section of the wall.

5. The article of claim 1, wherein an elastic element (88) resides between the trigger arm and the straw of the dispenser that applies a restoring force directing the trigger arm towards its neutral position when the trigger arm is displaced towards the dispenser base.

6. The article of claim 1, wherein the dispenser further comprises at least one gasket (51) positioned circumferentially around the straw between the straw and the sleeve and positioned between the entrance and exit ends of the straw.

7. The article of claim 1, wherein the article further comprises a can (90), wherein the can has a valve (91) that includes a valve cup (92) surrounding a stationary valve stem housing (94) in which a depressible valve stem (96) resides and which extends out from or is accessible through a top side (98) of the stationary valve stem housing and wherein the dispenser is attachable to the valve of the can by inserting the stationary valve stem housing into the entrance opening of the flow channel of the dispenser base while inserting the dispenser base into the valve cup of the valve and further characterized in that the plunger of the straw extends far enough into the flow channel of the bendable segment so as to compress the depressible valve stem to open the valve when the bendable segment is in a tilted position but not so far as to compress the valve stem to an open position when the bendable segment is in its neutral position.

8. The article of claim 7, wherein an outer surface of the base wall and an inner surface of the cup have threading (100) that mate in a threaded manner.

* * * * *